US006164632A

United States Patent [19]

Uchida et al.

[11] Patent Number: 6,164,632

[45] Date of Patent: Dec. 26, 2000

[54] METHOD FOR THE PREPARATION OF A CARBONATE SPRING

[75] Inventors: Makoto Uchida, Tokyo; Masanao Kobuke; Kenji Watari, both of Nagoya; Yoshinori Nagasaka, Tokyo, all of Japan

[73] Assignee: Mitsubishi Rayon Co., Ltd., Tokyo, Japan

[21] Appl. No.: 09/368,168

[22] Filed: Aug. 5, 1999

Related U.S. Application Data

[63] Continuation of application No. PCT/JP98/00458, Feb. 4, 1998.

[30] Foreign Application Priority Data

Feb. 5, 1997 [JP] Japan ..... 9-022586
Dec. 19, 1997 [JP] Japan ..... 9-351141

[51] Int. Cl.[7] ..... B01F 3/04

[52] U.S. Cl. ..... 261/102; 261/105; 261/DIG. 7

[58] Field of Search ..... 261/100, 105, 261/102, DIG. 7

[56] References Cited

U.S. PATENT DOCUMENTS

| | | | |
|---|---|---|---|
| 3,746,323 | 7/1973 | Buffington | 261/DIG. 7 |
| 4,051,034 | 9/1977 | Amon et al. | 261/DIG. 7 |
| 5,288,311 | 2/1994 | Furutani et al. | 96/110 |
| 5,347,665 | 9/1994 | Kumon et al. . | |
| 5,514,264 | 5/1996 | Shane | 261/DIG. 7 |
| 5,667,769 | 9/1997 | Kuckens et al. . | |
| 5,758,828 | 6/1998 | Takahashi . | |

FOREIGN PATENT DOCUMENTS

| | | |
|---|---|---|
| 0 717 975 A2 | 6/1996 | European Pat. Off. . |
| 41 24728 C1 | 10/1992 | Germany . |
| 60-102020 | 7/1985 | Japan . |
| 7-000779 | 1/1995 | Japan . |
| 7-313855 | 12/1995 | Japan . |
| 7-313856 | 12/1995 | Japan . |
| 7-328403 | 12/1995 | Japan . |
| 7-328404 | 12/1995 | Japan . |
| 8-019784 | 1/1996 | Japan . |
| 8-215270 | 8/1996 | Japan . |
| 8/215271 | 8/1996 | Japan . |
| 8-281087 | 10/1996 | Japan . |
| WO 93/13746 | 7/1993 | WIPO . |

*Primary Examiner*—C. Scott Bushey
*Attorney, Agent, or Firm*—Pillsbury Madison & Sutro LLP

[57] ABSTRACT

The described method is for the preparation of a carbonate spring by supplying carbon dioxide to a carbon dioxide dissolver and dissolving the carbon dioxide in raw water and includes of measuring the pH of the formed carbonate spring, calculating the carbon dioxide concentration data of the formed carbonate spring from the measured pH value and the alkalinity of the raw water, and controlling the feed rate of the carbon dioxide supplied to the carbon dioxide dissolver so as to make the carbon dioxide concentration data equal to a preset target carbon dioxide concentration value. According to this method, a carbonate spring having a desired concentration can be easily prepared by using an inexpensive pH measuring device.

24 Claims, 4 Drawing Sheets

METHOD FOR THE PREPARATION OF A CARBONATE SPRING

This is a Continuation of International Appln. No. PCT/JP98/00458 filed Feb. 4, 1998, published as WO98/34579 on Aug. 13, 1998.

TECHNICAL FIELD

This invention relates to a method for the preparation of a physiologically effective carbonate spring which permits a carbonate spring having a predetermined carbon dioxide concentration to be easily obtained at home and the like.

BACKGROUND ART

Owing its excellent warmth-keeping effect, a carbonate spring has long been used in bathhouses and other facilities utilizing a hot spring. Basically, the warmth-keeping effect of a carbonate spring is believed to be based on the fact that the physical environment of human beings is improved owing to the peripheral vasodilative effect of carbon dioxide contained therein. Moreover, the percutaneous absorption of carbon dioxide causes an increase and dilation of the capillary bed and thereby improves blood circulation through the skin. Consequently, a carbonate spring is said to be effective for the treatment of degenerative diseases and peripheral circulatory disorders.

Since a carbonate spring has such excellent effectiveness, attempts have been made to prepare a carbonate spring artificially. For example, a carbonate spring has been prepared by bubbling carbon dioxide through a bath, by effecting the chemical reaction of a carbonate with an acid, or by sealing warm water and carbon dioxide in a tank under pressure for a certain period of time. Moreover, Japanese Patent Laid-Open No. 279158/'90 has proposed a method which comprises supplying carbon dioxide through a hollow fiber semipermeable membrane and thereby causing it to be absorbed into water.

Although a variety of apparatus for the preparation of a carbonate spring are now on the market, none of them are known to be capable of measuring and controlling the carbon dioxide concentration of the carbonate spring. One reason for this is that the carbon dioxide concentration of a carbonate spring is within a relatively low range, for example, of 100 to 140 ppm. However, since the effectiveness of a carbonate spring varies somewhat according to the carbon dioxide concentration, it might be desirable to prepare a carbonate spring having a higher concentration or a carbonate spring having a lower concentration.

A number of devices for measuring the concentration of carbon dioxide dissolved in water have conventionally been known. A carbon dioxide concentration meter of the flow type is composed of a carbon dioxide electrode and a carbon dioxide concentration indicator, but the diaphragm and internal fluid of the electrode must be replaced at intervals of 1 to 3 months. Thus, since this device requires troublesome maintenance and is rather expensive, it is not suitable for practical use as a measuring instrument in apparatus for the preparation of a carbonate spring. Carbon dioxide concentration meters of the thermal conductivity detection type, which are being used in apparatus for the preparation of carbonated drinks, are very expensive and unsuitable for the purpose of measuring the concentration of a carbonate spring.

A method for maintaining a constant carbon dioxide concentration in a bath by installing a pH sensor in the bath and controlling the feed rate of carbon dioxide supplied to the carbon dioxide dissolver is disclosed in Japanese Patent Laid-Open No. 215270/'96. However, owing to the influence of impurities dissolved in the carbonate spring within the bathtub or the quality of the raw water, a uniquely defined relationship between the pH and carbon dioxide concentration of the carbonate spring within the bathtub is not always established. Consequently, it is difficult to adjust the carbon dioxide concentration in a bath to a specified target value according to this method.

DISCLOSURE OF THE INVENTION

An object of the present invention is to provide a method which permits a carbonate spring having a specific concentration to be easily prepared at home and the like.

That is, the present invention provides a method for the preparation of a carbonate spring by supplying carbon dioxide to a carbon dioxide dissolver and dissolving the carbon dioxide in raw water, which comprises the steps of measuring the pH of the carbonate spring formed in the carbon dioxide dissolver, calculating the carbon dioxide concentration data of the formed carbonate spring from the measured pH value and the alkalinity of the raw water, and controlling the feed rate of the carbon dioxide supplied to the carbon dioxide dissolver so as to make the carbon dioxide concentration data equal to a preset target carbon dioxide concentration value.

BEST MODE FOR CARRYING OUT THE INVENTION

The present invention is more specifically described hereinbelow with reference to the accompanying drawings.

Figure 1:
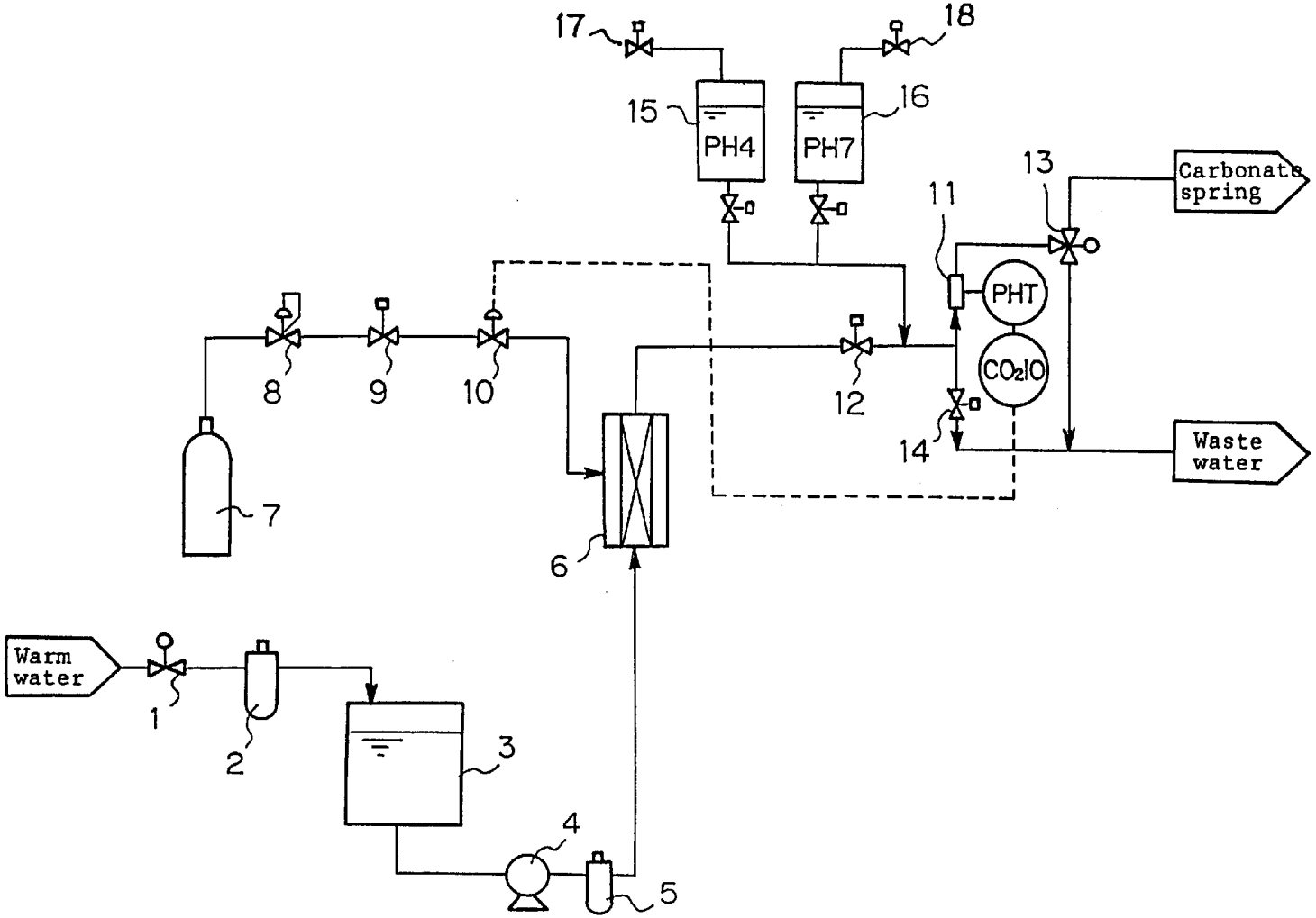
FIG. 1 is a flow sheet illustrating one embodiment of the apparatus used for carrying out the method for the preparation of a carbonate spring in accordance with the present invention.

FIG. 1 is a flow sheet illustrating one embodiment of the method for the preparation of a carbonate spring in accordance with the present invention. Warm water obtained by heating raw water such as tap water is fed to a warm water tank 3 by way of a motor-operated valve 1 and a prefilter 2, and stored therein. Then, using a feed pump 4, the warm water is introduced into a carbon dioxide dissolver 6 by way of a check filter 5 for trapping any foreign matter present in the warm water. Carbon dioxide is supplied from a carbon dioxide cylinder 7 to the carbon dioxide dissolver by way of a pressure reducing valve 8, an on-off valve 9, and a control valve as a means for regulating the flow rate of carbon dioxide. The carbon dioxide dissolver used in the embodiment includes a built-in membrane module having a hollow fiber membrane incorporated therein. In this carbon dioxide dissolver, carbon dioxide is supplied to the outer surface side of the hollow fibers and brought into contact with raw water flowing through the inner cavities of the hollow fibers through the medium of the membrane constituting the hollow fibers, so that the carbon dioxide is dissolved in the raw water and the resulting carbonate spring is discharged from the carbon dioxide dissolver.

When a carbon dioxide dissolver having a built-in membrane module is used so as to cause carbon dioxide to be dissolved raw water through the medium of the membrane, the gas-liquid contact area can be maximized and this permits carbon dioxide to be dissolved with high efficiency. The membrane modules which can be used for this purpose include hollow fiber membrane modules, flat membrane modules, spiral type modules and the like. Among others, hollow fiber membrane modules permit carbon dioxide to be dissolved with the highest efficiency.

Figure 2:
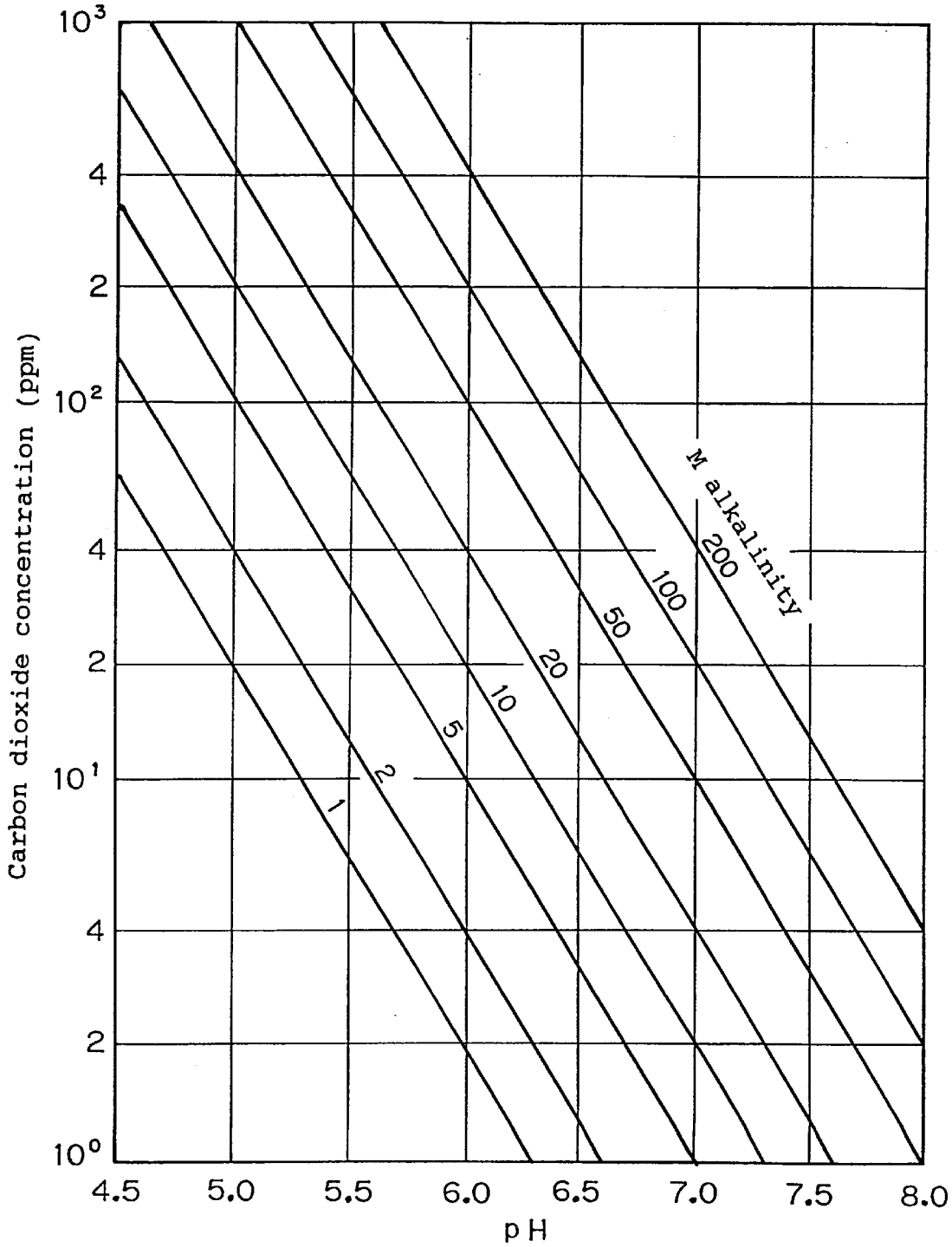
FIG. 2 is a graph showing the relationship between the carbon dioxide concentration and pH of a carbonate spring at various alkalinities of raw water.

The pH of the carbonate spring so formed in the carbon dioxide dissolver is measured with a pH sensor 11. Although there is a definite relationship between the carbon dioxide concentration and pH of a carbonate spring, it is impossible to determine the carbon dioxide concentration of the carbonate spring uniquely from its pH. That is, as shown in FIG. 2, the relationship between the carbon dioxide concentration and pH of a carbonate spring varies greatly according to the alkalinity of raw water. Consequently, in the method of the present invention, the pH of the formed carbonate spring which has been measured with the pH sensor and the value for the alkalinity of the raw water are fed into an arithmetical unit, where carbon dioxide concentration data is calculated by utilizing the relationship between pH and alkalinity as shown in FIG. 2, and produced as an output.

If raw water is obtained from a fixed source of water (e.g., tap water), its alkalinity generally show little variation with time. Accordingly, once the alkalinity of raw water is measured before installing and operating the apparatus for the preparation of a carbonate spring, the measured value can be used thereafter.

As a matter of course, the alkalinity of raw material may be measured each time the apparatus for the preparation of a carbonate spring is used, and the value thus obtained may be fed into the arithmetical unit. The term "alkalinity" as used herein is a measure for expressing the content of components contained in the raw water and consuming acids, such as $OH^-$, $CO_3^{2-}$ and $HCO_3^-$, and it is preferable to employ pH 4.8 alkalinity (i.e., M alkalinity).

In the present invention, the carbon dioxide concentration data of the carbonate spring which has been calculated in the above-described manner is compared with the target carbon dioxide concentration which is desired by the user and has been preset before starting the operation of the apparatus for the preparation of a carbonate spring. Thus, the feed rate of carbon dioxide supplied to the carbon dioxide dissolver is regulated so that a carbonate spring having the target carbon dioxide concentration will be obtained. Various means may be employed in order to regulate the feed rate of carbon dioxide. Although flow control valve 10 is used in this embodiment, the feed rate of carbon dioxide may also be regulated by controlling it with a pressure regulating valve.

It is preferable that the pH sensor is usually installed in the neighborhood of the outlet of the carbon dioxide dissolver so as to prevent it from being affected by any factor disturbing the control. However, irrespective of the installation site of the pH sensor, the accuracy of measurement is reduced with time, for example, owing to contamination by the liquid to be measured. Accordingly, it is preferable to calibrate the pH sensor periodically. In particular, errors of the pH measured with the pH sensor must be kept within the limit of ±0.05 in order to keep errors of the carbon dioxide concentration data within the limit of several percent. To this end, it is preferable to calibrate the pH sensor at intervals of one or two weeks.

The pH sensor may be carried out as follows. First of all, the liquid (i.e., the carbonate spring) within the holder of the pH sensor is discharged by closing a motor-operated valve 12 and a motor-operated three-way valve 13, and opening a motor-operated valve 14. Thereafter, the pH sensor is calibrated for pH 4 by closing valve 14 and filling the holder with a pH 4 standard solution supplied from a standard solution tank 15. Subsequently, the pH 4 standard solution is discharged from the holder by opening valve 14. Thereafter, the pH sensor is calibrated for pH 7 by closing valve 14 and filling the holder with a pH 7 standard solution supplied from a standard solution tank 16. Thus, the calibration of the pH sensor is completed by calibrating it for two different pH values. In this connection, the vent pipes of the standard solution tanks are equipped with solenoid-operated valves 17 and 18 so that the standard solutions may usually be isolated from the outside air and thereby prevented from being deteriorated.

Figure 3:
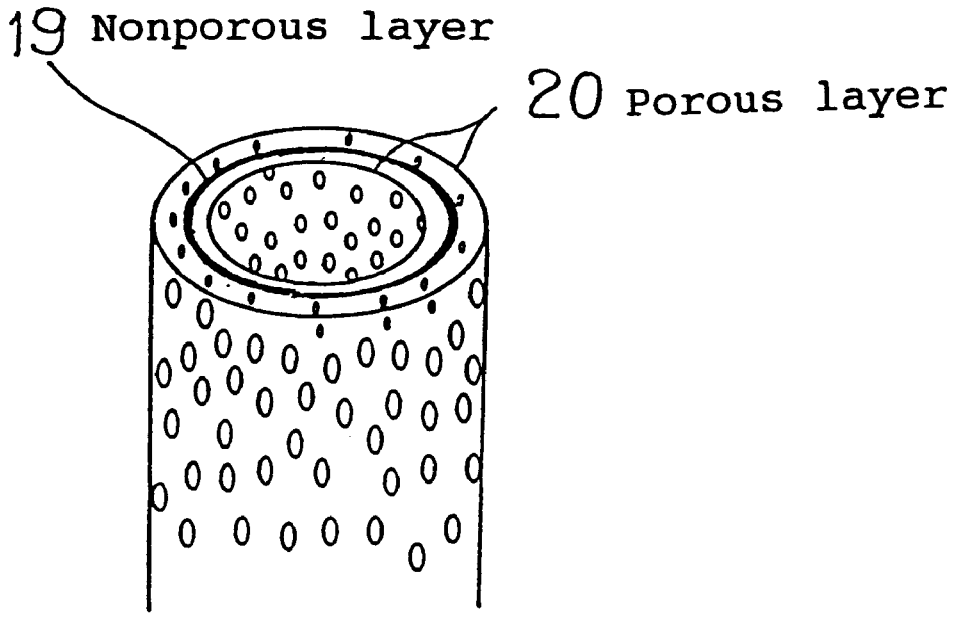
FIG. 3 is a schematic view of a composite hollow fiber membrane of three-layer structure which is suitable for use in the method for the preparation of a carbonate spring in accordance with the present invention.

As the hollow fiber membrane used in carbon dioxide dissolver 9 there may be used any of various hollow fiber membranes having high gas permeability. The hollow fiber membrane may be a porous membrane or a nonporous membrane. Where a porous hollow fiber membrane is used, the openings in its surface should preferably have a diameter of 0.01 to 10 $\mu$m. The most preferred hollow fiber membrane is a composite hollow fiber membrane of three-layer structure comprising a nonporous thin-film layer interposed between two porous layers, and a specific example thereof is a three-layer composite hollow fiber membrane [MHF (trade name)] manufactured by Mitsubishi Rayon Co., Ltd. FIG. 3 is a schematic view illustrating one example of such composite hollow fiber membranes. In FIG. 3, numeral 19 designates a nonporous layer and numeral 20 designates a porous layer.

The nonporous layer (or film) used herein is a film which permits a gas to permeate therethrough by a mechanism involving its dissolution and diffusion in the matrix of the film, and may comprise any film substantially free of openings through which gas molecules can pass, as is the case with the Knudsen flow. The use of a nonporous film not only permits carbon dioxide to be supplied at any desired pressure and dissolved efficiently without releasing gas bubbles into the carbonate spring, but also permit carbon dioxide to be easily dissolved with such good controllability as to give any desired concentration. Moreover, the use of a nonporous film can also prevent warm water from flowing back through pores to the gas supply side, as may rarely be observed with porous membranes. The aforesaid composite hollow fiber membrane of three-layer structure is preferred in that the nonporous layer is formed in the form of a very thin film having high gas permeability and protected by the porous layers so as to be scarcely subject to damage. Moreover, since little carbon dioxide is released into the carbonate spring in the form of gas bubbles, pH measurements can be made with high accuracy.

The hollow fiber membrane preferably has a thickness of 10 to 150 $\mu$m. If its thickness is less than 10 $\mu$m, the membrane will tend to have an insufficient strength. If its thickness is greater than 150 $\mu$m, the permeation rate of carbon dioxide will be reduced and hence tend to cause a reduction in dissolution efficiency. In the case of the composite hollow fiber membrane of three-layer structure, the thickness of the nonporous film is preferably in the range of 0.3 to 2 μm. If its thickness is less than 0.3 μm, the membrane will be subject to deterioration, and such deterioration of the membrane may cause leakage. If its thickness is greater than 2 μm, the permeation rate of carbon dioxide will be reduced and hence tend to cause a reduction in dissolution efficiency.

Preferred examples of the membrane material of the hollow fiber membrane include silicones, polyolefins, polyesters, polyamides, polyimides, polysulfones, cellulosics and polyurethanes. Preferred examples of the material of the nonporous film in the composite hollow fiber membrane of three-layer structure include polyurethanes, polyethylene, polypropylene, poly(4-methylpentene-1), polydimethylsiloxane, polyethyl cellulose and polyphenylene oxide. Among others, polyurethanes are especially preferred because they have good film-forming properties and a low content of water-soluble matter.

The hollow fiber membrane preferably has an inside diameter of 50 to 1,000 μm. If its inside diameter is less than 50 μm, the flow resistance of carbon dioxide flowing through the inner cavities of the hollow fibers will be increased to such an extent that it is difficult to supply carbon dioxide. If its inside diameter is greater than 1,000 μm, the dissolver will have an unduly large size and fail to construct a compact apparatus.

Where a hollow fiber membrane is used in the carbon dioxide dissolver, there are two methods: the method in which carbon dioxide is dissolved in raw water by supplying the carbon dioxide to the inner cavity side of the hollow fiber membrane while feeding the raw water to the outer surface side thereof, and the method in which carbon dioxide is dissolved in raw water by supplying the carbon dioxide to the outer surface side of the hollow fiber membrane while feeding the raw water to the inner cavity side thereof. The method in which carbon dioxide is dissolved in raw water by supplying the carbon dioxide to the outer surface side of the hollow fiber membrane while feeding the raw water to the inner cavity side thereof is preferred, because carbon dioxide can be dissolved in warm water at a high concentration, irrespective of the form of the membrane module.

In the method of the present invention, there may also be used a carbon dioxide dissolver equipped with gas diffusion means having a gas diffuser section consisting of a porous body and disposed at the bottom of the carbon dioxide dissolver. Although no particular limitation is placed on the material and shape of the porous body used in the gas diffuser section, its porosity (i.e., the proportion of the volume of interstices present in the porous body to the total volume of the porous body) is preferably in the range of 5 to 70% by volume. Lower porosities are more suitable for the purpose of further enhancing the dissolution efficiency of carbon dioxide, and it is preferable to use a porous body having a porosity of 5 to 40% by volume. If its porosity is greater than 70% by volume, it will become difficult to control the flow rate of carbon dioxide. That is, its flow rate will become unduly high even at low carbon dioxide pressures and the carbon dioxide bubbles released from the gas diffuser section will become unduly large, resulting in a reduction in dissolution efficiency. If its porosity is less than 5% by volume, the feed rate of carbon dioxide will be reduced and, therefore, a long time will tend to be required for the dissolution of carbon dioxide.

Moreover, in order to control the flow rate of carbon dioxide being diffused and form fine gas bubbles, the openings in the surface of the porous body preferably have a diameter of 0.01 to 10 μm. If their diameter is greater than 10 μm, the gas bubbles rising through the water will become unduly large and tend to cause a reduction in the dissolution efficiency of carbon dioxide. If their diameter is less than 0.01 μm, the amount of carbon dioxide diffused into the water will be reduced and, therefore, a long time will tend to be required for the preparation of a carbonate spring having a high concentration.

As the surface area of the porous body used in the gas diffuser section of the gas diffusion means becomes larger, a greater number of gas bubbles can be produced to achieve more efficient contact between carbon dioxide and warm water. Moreover, the dissolution of carbon dioxide occurs prior to the formation of gas bubbles, resulting in an enhancement in dissolution efficiency. Accordingly, it is preferable to use a porous body having a large surface area, though no particular limitation is placed on its shape. There are various methods for increasing its surface area. For example, this can be done by forming the porous body into a pipe or by forming the porous body into a flat plate having an undulating surface. However, it is preferable to use a porous hollow fiber membrane. In particular, it is effective to use a large number of porous hollow fibers bound into a bundle.

The materials which can be used for the porous body include, but are not limited to, metals, ceramics, plastics and the like. However, hydrophilic materials are undesirable because warm water may penetrate through surface pores into the gas diffusion means during stoppage of carbon dioxide supply.

Figure 4:
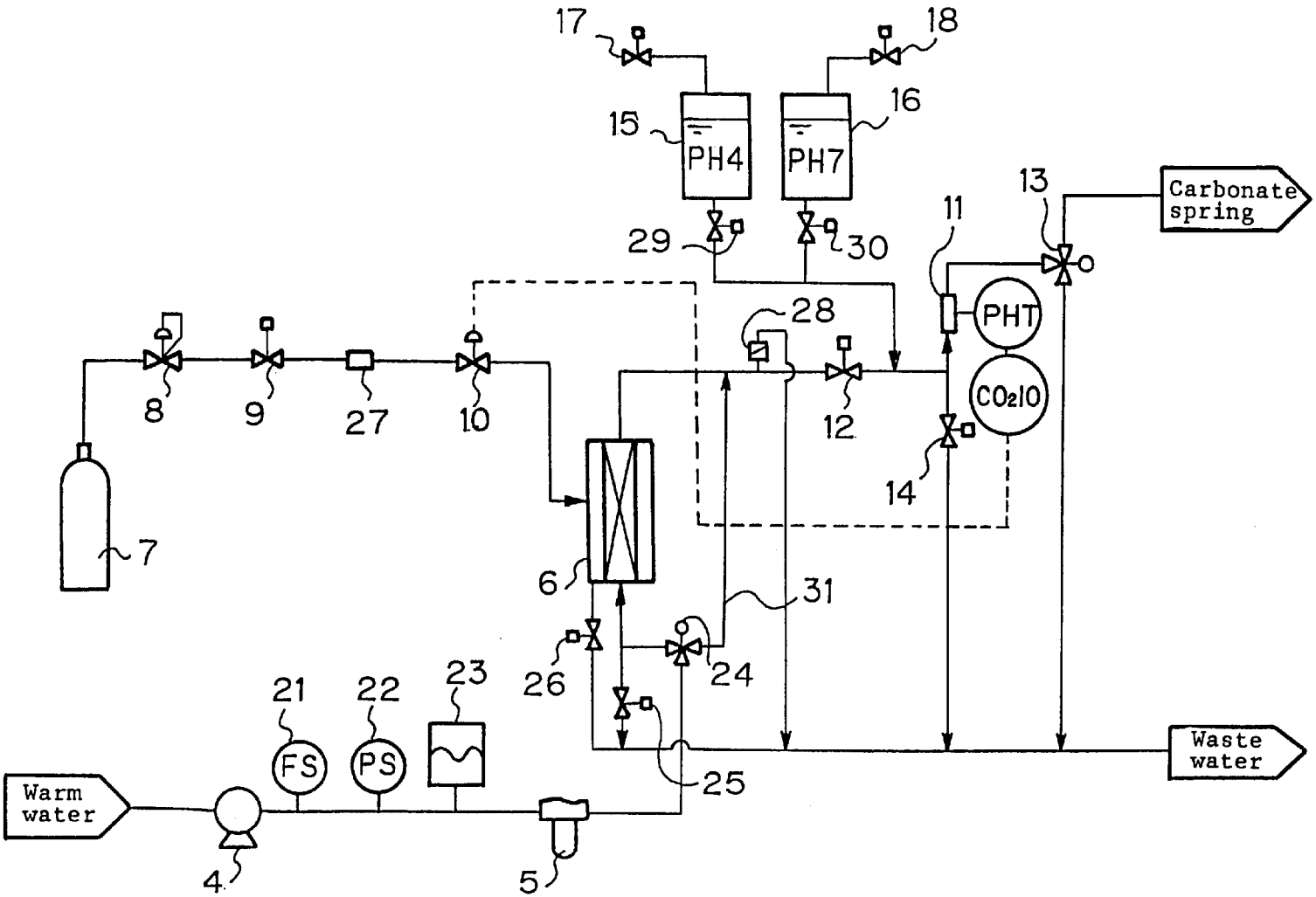
FIG. 4 is a flow sheet illustrating another embodiment of the apparatus used for carrying out the method for the preparation of a carbonate spring in accordance with the present invention.

FIG. 4 is a flow sheet illustrating another embodiment of the method for the preparation of a carbonate spring in accordance with the present invention. In this embodiment, warm water is fed with the aid of a feed pump 4 and a pressure tank 23 without installing a warm water tank. That is, when a terminal valve on the delivery side of the carbonate spring is opened, warm water begins to flow. This flow is detected with a flow switch 21 to operate feed pump 4 automatically. On the other hand, when the terminal valve is closed, the pressure within the piping system rises as a result of the operation of feed pump 4, but pressure tank 23 functions as a pressure buffer. As soon as a predetermined upper limit of pressure is reached, a pressure switch 22 is operated to stop feed pump 4.

Carbon dioxide dissolver 6, which has a hollow fiber membrane incorporated therein and serves to dissolve carbon dioxide in warm water by making the water flow through the inner cavities of the hollow fibers and thereby bringing it into contact with carbon dioxide, is equipped with a pipe line 31 for back washing. It has been found that, when warm water having passed through a prefilter is made to flow through the inner cavities of the hollow fibers within dissolver 6 for a long period of time, scale is deposited at the open potted ends of the hollow fibers which constitute the inlets to the inner cavities of the hollow fibers, resulting in a gradual reduction in the flow rate of the formed carbonate spring. However, it has also be found that such scale can be relatively easily removed by making water to flow through carbon dioxide dissolver 6 in the reverse direction. Specifically, the warm water is made to flow through the hollow fibers in the reverse direction by closing solenoid-operated valve 12, opening an on-off valve 25, and turning a three-way valve 24 to the pipe line for back washing. This back washing may be carried out by making a stream of water flow at a common water pressure of about 1 to 3 $kg/cm^2$ for a period of about 0.5 to 30 minutes. This back washing is preferably carried out at intervals of about 1 to 4 weeks, depending upon the service time of the carbon dioxide dissolver. Although scale deposition can also be prevented by using a filter of finer mesh as the check filter installed upstream of the carbon dioxide dissolver, this causes an unduly great pressure loss and is hence impractical.

Carbon dioxide dissolver 6 is provided with a drain pipe which communicates with the outer space of the hollow fibers. Thus, the drain resulting from steam generated in the inner cavities of the hollow fibers and condensed in the outer space of the hollow fibers can be discharged out of the system, as required, by opening a discharge valve 26.

An excess flow stop valve 27 is installed on the upstream side of flow control valve 10 for carbon dioxide. If carbon dioxide leaks for some cause to produce an excess flow of carbon dioxide, this excess flow stop valve 27 shuts it off automatically and thereby secures the safety of the apparatus for the preparation of a carbonate spring.

A vent valve 28 is installed on the downstream side of carbon dioxide dissolver 6 in order to remove undissolved carbon dioxide contained in the resulting carbonate spring in the form of gas bubbles and discharge it into the drain pipe. As this vent valve 28, there may be used a vent valve similar to those usually used in common warm water pipe lines. The installation of a vent valve is preferable because carbon dioxide in the form of gas bubbles is scarcely absorbed through the skin and hence fails to produce a carbonate spring effect on the human body, and because its use is effective in reducing the carbon dioxide concentration in the air of the bathroom. In other respects, the apparatus of FIG. 4 is the same as that of FIG. 1.

The present invention is further illustrated by the following example.

EXAMPLE 1

A carbonate spring was prepared by using an apparatus as illustrated in the flow sheet of FIG. 1. In this example, there was used a carbon dioxide dissolver having the previously described three-layer composite hollow fiber membrane MHF incorporated therein so as to give a total effective membrane area of 2.4 $m^2$.

Warm water obtained heating tap water having an M alkalinity of 16.0 to 40° C. was fed to the carbon dioxide dissolver at a flow rate of 10 liters per minute. The target carbon dioxide concentration of a carbonate spring was preset at 600 ppm. On the other hand, the pH of the carbonate spring obtained in the carbon dioxide dissolver was detected with a pH sensor, and carbon dioxide concentration data was calculated with a CPU from the measured pH value and the M alkalinity of the tap water. Then, carbon dioxide was supplied to the carbon dioxide dissolver by controlling the opening of the flow control valve for carbon dioxide so as to cause the aforesaid concentration data to agree with the target carbon dioxide concentration. As a result, the carbon dioxide concentration of the carbonate spring obtained 4 minutes after starting the operation was found to be 615 ppm, indicating that a carbonate spring having a carbon dioxide concentration almost equal to the target carbon dioxide concentration was formed. Carbon dioxide concentrations were measured with the carbon dioxide electrode CE-235 of an Ion Meter IM40S manufactured by Toa Electronics Ltd.

INDUSTRIAL APPLICABILITY

The method for the preparation of a carbonate spring in accordance with the present invention permits a carbonate spring having a desired carbon dioxide concentration to be easily prepared at home and the like by using an inexpensive pH measuring device.

What is claimed is:

1. A method for the preparation of a carbonate spring by supplying carbon dioxide to a carbon dioxide dissolver and dissolving the carbon dioxide in raw water, which comprises the steps of measuring the pH of the carbonate spring formed in the carbon dioxide dissolver, calculating the carbon dioxide concentration data of the formed carbonate spring from the measured pH value and the alkalinity of the raw water, and controlling the feed rate of the carbon dioxide supplied to the carbon dioxide dissolver so as to make the carbon dioxide concentration data equal to a preset target carbon dioxide concentration value.

2. A method for the preparation of a carbonate spring as claimed in claim 1 wherein there is used a carbon dioxide dissolver having a built-in membrane module.

3. A method for the preparation of a carbonate spring as claimed in claim 2 wherein the membrane module has a hollow fiber membrane incorporated therein.

4. A method for the preparation of a carbonate spring as claimed in claim 3 wherein the carbon dioxide is supplied to the outer surface side of the hollow fiber membrane and dissolved in the raw water fed to the inner cavity side thereof.

5. A method for the preparation of a carbonate spring as claimed in claim 1 wherein there is used a carbon dioxide dissolver having gas diffusion means comprising a porous body disposed at the bottom of the carbon dioxide dissolver and functioning as a gas diffuser.

6. A method for the preparation of a carbonate spring as claimed in claim 5 wherein the porous body has a porosity of 5 to 70% by volume and the openings in its surface have a diameter of 0.01 to 10 $\mu$m.

7. A method for the preparation of a carbonate spring as claimed in claim 5 wherein the porous body comprises a porous hollow fiber membrane.

8. A method for the preparation of a carbonate spring as claimed in claim 3 wherein the hollow fiber membrane has an inside diameter of 50 to 1,000 $\mu$m.

9. A method for the preparation of a carbonate spring as claimed in claim 4 wherein the hollow fiber membrane has an inside diameter of 50 to 1,000 $\mu$m.

10. A method for the preparation of a carbonate spring as claimed in claim 3 wherein the hollow fiber membrane has a thickness of 10 to 150 $\mu$m.

11. A method for the preparation of a carbonate spring as claimed in claim 4, wherein the hollow fiber membrane has a thickness of 10 to 150 $\mu$m.

12. A method for the preparation of a carbonate spring as claimed in claim 8 wherein the hollow fiber membrane has a thickness of 10 to 150 $\mu$m.

13. A method for the preparation of a carbonate spring as claimed in claim 9 wherein the hollow fiber membrane has a thickness of 10 to 150 $\mu$m.

14. A method for the preparation of a carbonate spring as claimed in claim 3 wherein the hollow fiber membrane is a composite hollow fiber membrane comprising a nonporous layer, in the form of a thin film, interposed between two porous layers.

15. A method for the preparation of a carbonate spring as claimed in claim 4 wherein the hollow fiber membrane is a composite hollow fiber membrane comprising a nonporous layer, in the form of a thin film, interposed between two porous layers.

16. A method for the preparation of a carbonate spring as claimed in claim 8 wherein the hollow fiber membrane is a composite hollow fiber membrane comprising a nonporous layer, in the form of a thin film, interposed between two porous layers.

17. A method for the preparation of a carbonate spring as claimed in claim 9 wherein the hollow fiber membrane is a composite hollow fiber membrane comprising a nonporous layer, in the form of a thin film, interposed between two porous layers.

18. A method for the preparation of a carbonate spring as claimed in claim 10 wherein the hollow fiber membrane is a composite hollow fiber membrane comprising a nonporous layer, in the form of a thin film, interposed between two porous layers.

19. A method for the preparation of a carbonate spring as claimed in claim 11 wherein the hollow fiber membrane is a composite hollow fiber membrane comprising a nonporous layer, in the form of a thin film, interposed between two porous layers.

20. A method for the preparation of a carbonate spring as claimed in claim 12 wherein the hollow fiber membrane is a composite hollow fiber membrane comprising a nonporous layer, in the form of a thin film, interposed between two porous layers.

21. A method for the preparation of a carbonate spring as claimed in claim 13 wherein the hollow fiber membrane is a composite hollow fiber membrane comprising a nonporous layer, in the form of a thin film, interposed between two porous layers.

22. A method for the preparation of a carbonate spring as claimed in any one of claims 14 to 21 wherein the nonporous layer of the hollow fiber membrane has a thickness of 0.3 to 2 $\mu$m.

23. A method for the preparation of a carbonate spring as claimed in any one of claims 14 to 21 wherein the nonporous layer of the composite hollow fiber membrane comprises a polyurethane.

24. A method for the preparation of a carbonate spring as claimed in any one of claims 14 to 21 wherein the nonporous layer of the hollow fiber membrane has a thickness of 0.3 to 2 $\mu$m and the nonporous layer of the composite hollow fiber membrane comprises a polyurethane.

* * * * *